US009140250B2

(12) United States Patent
Stones et al.

(10) Patent No.: US 9,140,250 B2
(45) Date of Patent: Sep. 22, 2015

(54) VACUUM PUMPING SYSTEM

(75) Inventors: Ian David Stones, Burgess Hill (GB); Ian Olsen, Crawley (GB); Richard Glyn Horler, Crawley (GB)

(73) Assignee: EDWARDS LIMITED, Crawley, West Sussex (GB)

( * ) Notice: Subject to any disclaimer, the term of this patent is extended or adjusted under 35 U.S.C. 154(b) by 334 days.

(21) Appl. No.: 13/583,429

(22) PCT Filed: Feb. 25, 2011

(86) PCT No.: PCT/GB2011/050373
§ 371 (c)(1), (2), (4) Date: Sep. 7, 2012

(87) PCT Pub. No.: WO2011/121322
PCT Pub. Date: Oct. 6, 2011

(65) Prior Publication Data

US 2013/0028757 A1 Jan. 31, 2013

(30) Foreign Application Priority Data

Mar. 31, 2010 (GB) ..... 1005459.1

(51) Int. Cl.
*F04B 37/14* (2006.01)
*F04B 23/04* (2006.01)
(Continued)

(52) U.S. Cl.
CPC ..... *F04B 37/14* (2013.01); *F04B 23/04* (2013.01); *F04B 37/02* (2013.01); *F04B 37/06* (2013.01); *F04B 41/06* (2013.01); *F04C 25/02* (2013.01); *F04C 28/02* (2013.01); *F04C 28/065* (2013.01);
(Continued)

(58) Field of Classification Search
CPC ..... F04B 23/04; F04C 25/02; F04C 28/02; F04D 19/046
USPC ..... 417/244, 250, 251; 415/90, 99, 100, 415/144; 416/175, 198 A, 198 R
See application file for complete search history.

(56) References Cited

U.S. PATENT DOCUMENTS 4,472,962 A * 9/1984 Mennenga ..... 73/40.7
4,919,599 A * 4/1990 Reich et al. ..... 417/423.4
(Continued)

FOREIGN PATENT DOCUMENTS

DE 3639512 A1 6/1988
DE 42196268 A1 12/1993
(Continued)

OTHER PUBLICATIONS

Response dated Apr. 11, 2013 from corresponding European Application No. 11706924.5-2315.
(Continued)

*Primary Examiner* — Charles Freay
(74) *Attorney, Agent, or Firm* — Shaoni L. Mitchell

(57) ABSTRACT

The present invention relates to a vacuum pumping system (18) for evacuating gas from a plurality of chambers (12, 14, 16) at different pressures. The pumping system comprises a plurality of compound vacuum pumps (20, 22), wherein each compound pump comprises a plurality of pumping mechanisms (24,26,28) connected in series between a pump inlet (30) and a pump exhaust (32) and an interstage port (34, 36) between pumping mechanisms in the series. The system is configured such that gas evacuated from one of said chambers is pumped through the interstage ports of at least two of said compound pumps.

8 Claims, 7 Drawing Sheets

(51) Int. Cl.

| | |
|---|---|
| ***F04B 37/02*** | (2006.01) |
| ***F04B 37/06*** | (2006.01) |
| ***F04B 41/06*** | (2006.01) |
| ***F04C 25/02*** | (2006.01) |
| ***F04C 28/02*** | (2006.01) |
| ***F04C 28/06*** | (2006.01) |
| ***F04D 19/04*** | (2006.01) |

(52) U.S. Cl.
CPC ..... *F04D 19/046* (2013.01); *F04B 2201/1201* (2013.01); *F04C 2240/70* (2013.01)

(56) References Cited

U.S. PATENT DOCUMENTS

| | | | | |
|---|---|---|---|---|
| 5,228,838 | A | 7/1993 | Gebele et al. | |
| 6,193,461 | B1 * | 2/2001 | Hablanian | 415/90 |
| 7,850,434 | B2 * | 12/2010 | Stones | 417/250 |
| 8,764,413 | B2 * | 7/2014 | Stones | 417/203 |
| 2012/0132800 | A1 * | 5/2012 | Stones | 250/288 |

FOREIGN PATENT DOCUMENTS

| | | | |
|---|---|---|---|
| DE | 102008009715 | A1 | 8/2009 |
| WO | 2005113986 | A1 | 12/2005 |
| WO | 2009103701 | A1 | 8/2009 |

OTHER PUBLICATIONS

U.K. Search Report dated Jul. 26, 2010 from corresponding British Application No. GB1005459.1.

PCT International Search Report dated Jan. 2, 2012 from corresponding PCT Application No. PCT/GB2011/050373, filed Feb. 25, 2011.

PCT Written Opinion dated Jan. 2, 2012 from corresponding PCT Application No. PCT/GB2011/050373, filed Feb. 25, 2011.

* cited by examiner

VACUUM PUMPING SYSTEM

The present invention relates to a vacuum pumping system for differentially pumping a plurality of chambers and to a vacuum system comprising a plurality of vacuum chambers and a vacuum pumping system.

A prior art vacuum system 50 is shown in FIG. 7 which comprises a plurality of chambers 52 and a vacuum pumping system 54 for evacuating gas from the chambers at different pressures. Three vacuum chambers are shown which are connected to allow the flow of gas from an upstream chamber at relatively high pressure to a downstream chamber at relatively low pressure. This arrangement may be used for scientific equipment such as a mass spectrometer. The pressure in the three vacuum chambers may range from in the region $10^{-3}$ to $10^{-6}$ mbar in the low pressure chamber to about 10 mbar in the relatively high pressure chamber.

The vacuum pumping system comprises two compound pumps 56 connected to respective chambers and a primary pump 58 connected to a third chamber. The primary pump may be a scroll pump and is additionally used to back the two compound pumps. The compound pumps typically comprise a turbomolecular pumping mechanism, drag pumping mechanism and a regenerative pumping mechanism connected in series.

It is known to provide a compound pump with interstage ports between pumping mechanisms in the series. An interstage port can be connected to a vacuum chamber so that gas from the chamber can be pumped through one or two but not all of the pumping mechanisms. That is gas is pumped only through the pumping mechanisms downstream of the interstage port whereas gas entering a main pump inlet is pumped by all of the pumping mechanisms. This arrangement allows the chamber connected to the interstage port to be evacuated at a first pressure which is different from the pressure of another chamber connected to the main inlet of the pump.

The present invention provides a vacuum pumping system demonstrating improved pumping speed, compression or gas throughput.

The present invention provides a vacuum pumping system for evacuating gas from a plurality of chambers at different pressures, the pumping system comprising a plurality of compound vacuum pumps, wherein each compound pump comprises a plurality of pumping mechanisms connected in series between a pump inlet and a pump exhaust and an interstage port between pumping mechanisms in the series, wherein the system is configured such that gas evacuated from one of said chambers is pumped through the interstage ports of at least two of said compound pumps.

Other preferred and/or optional aspects of the invention are defined in the accompanying claims.

In order that the present invention may be well understood, several embodiments thereof, which are given by way of example only, will now be described with reference to the accompanying drawings, in which.

Figure 1:
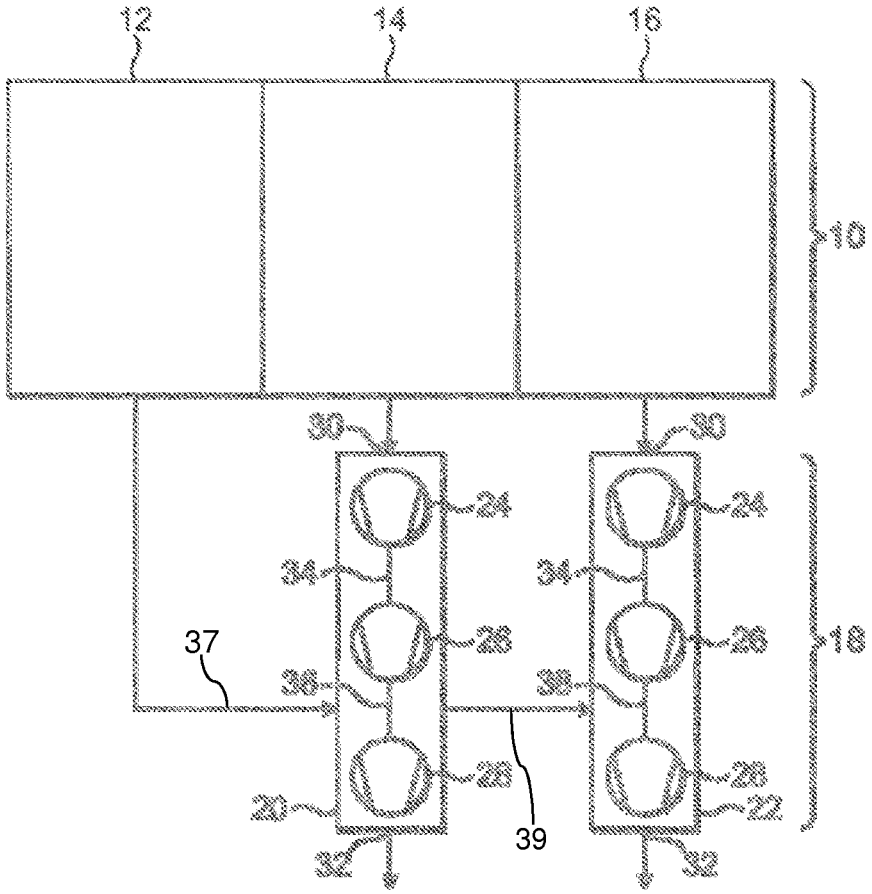
FIG. 1 shows a vacuum system comprising a plurality of vacuum chambers and a vacuum pumping system.

Referring to FIG. 1, a vacuum system 10 is shown comprising a plurality of vacuum chambers 12, 14, 16 and a vacuum pumping system 18 for evacuating gas from the chambers at different pressures. That is, the vacuum pumping system 18 is adapted for differentially pumping chambers 12, 14, 16. For example, chamber 12 may be maintained at a pressure between 10 and 1 mbar, chamber 14 may be maintained at a pressure between 1 and $10^{-3}$ mbar and chamber 16 may be maintained at a pressure between $10^{-3}$ and $10^{-6}$ mbar.

The vacuum pumping system 18 comprises a plurality of compound vacuum pumps 20, 22. Two such pumps are shown in FIG. 1 although more pumps may be used particularly if more than three chambers require evacuation (see FIG. 5). Each compound pump comprises a plurality of pumping mechanisms 24, 26, 28 connected in series between a pump inlet 30 and a pump exhaust 32. The compound pumps in the embodiments shown herein comprise a turbomolecular pumping mechanism 24, a molecular drag pumping mechanism (such as a Siegebahn or Holweck pumping mechanism) 26 and a regenerative pumping mechanism 28. However, other types of pumping mechanisms may be used depending on requirement. The pumping mechanisms of each pump comprise rotor parts supported for rotation by a drive shaft and stator parts fixed relative and typically supported by a pump housing.

Although in this example three pumping mechanisms are shown in each pump, more or fewer pumping mechanisms may be provided as required. Further, each or more than one of the pumping mechanisms in the pumps may be the same type of pumping mechanism, for example two turbomolecular pumping mechanisms may be in series with one molecular drag pumping mechanism. Still further, the compound pumps in the vacuum pumping system may have different arrangements with different numbers of pumping mechanisms and different types of pumping mechanisms.

In each pump 20, 22, an interstage port 34, 36 is located between pumping mechanisms in the series such that gas can be introduced to the pump or exhausted from the pump through an interstage port. As each compound pump comprises three pumping mechanisms in this example, two interstage ports are provided. If only two pumping mechanisms are provided then only one interstage port is required. Also, whilst it is preferable that an interstage port is located between each pair of adjacent pumping mechanisms in a series, the invention covers an arrangement having a pump in which interstage ports are not provided between every pair of adjacent pumping mechanisms in a series.

The interstage ports are formed to convey gas from outside the pump housing for pumping by one or each of the pumping mechanisms downstream of the interstage port. Therefore, an interstage port is formed by an aperture in the pump housing which is typically configured for receiving ducting for connecting the port to a vacuum chamber. The port conveys gas from the vacuum chamber to an inlet to the first downstream pumping mechanism.

In the Figures, the first interstage port 34 is located between the first pumping mechanism 24 which is upstream thereof and the second pumping mechanism 26 which is downstream thereof. The second interstage port 36 is located between the second pumping mechanism 26 which is upstream thereof and the third pumping mechanism 28 which is downstream thereof. The pumping system is configured such that gas evacuated from the first chamber 12 is pumped through at least one of the interstage ports of both of the compound pumps 20, 22. In this regard, gas that is pumped through the or each interstage port is pumped by the or each downstream pumping mechanism. Accordingly, and for example, gas pumped through interstage port 34 in pump 20 may be pumped by pumping mechanism 26 and then exhausted through interstage port 36. Alternatively, gas pumped through interstage port 34 in pump 20 may be pumped by pumping mechanisms 26 and 28 in series and then exhausted through the pump exhaust 32.

As will be described in more detail hereinafter, one or both of the second 26 and third 28 pumping mechanisms of a first 20 of the compound pumps can be connected in series or parallel for pumping gas from a chamber with one or both of the second 26 and third 28 pumping mechanisms of the second 22 of the compound pumps.

It will also be appreciated that the interstage ports 34, 36 of more than one pump 20, 22 can be connected to more than one vacuum chamber and in different combinations depending on requirements. For example, any one of the arrangement shown in the embodiments can be used in combination with any of the other arrangements shown in the embodiments.

In FIGS. 1 to 5, vacuum chamber 12 is connected to an interstage port of two compound pumps 20, 22 and the other vacuum chambers 14, 16 are connected to the pump inlets 30 of respective compound pumps 20, 22. One or more primary pumps which for example may be scroll pumps and exhaust to atmosphere are used to back the compound pumps 20, 22 and 46. An alternative arrangement is shown in FIG. 6 and will be described in greater detail below.

Referring now in more detail to FIG. 1, the system is configured such that interstage ports 36 of compound pumps 20, 22 are connected to chamber 12 by respective conduits 37 and 39 so that gas from the chamber can be pumped by respective third pumping mechanisms 28 of the compound pumps 20, 22. The system is arranged so that the third pumping mechanisms 28 pump gas in parallel at the same time since the pumping mechanisms 28 are downstream of respective interstage ports 36. Accordingly, chamber 12 is evacuated by the final pumping mechanisms of both of the pumps 20, 22, which as indicated above may be regenerative type pumping mechanism capable of pumping at about 10 mbar.

In FIG. 1, the gas load from chamber 12 is divided between two pumping mechanisms which can increase pumping speed at the chamber. Therefore, a lower chamber pressure can be achieved or a larger gas flow can be handled which can provide for instance greater instrument performance for a mass spectrometer.

Figure 2:
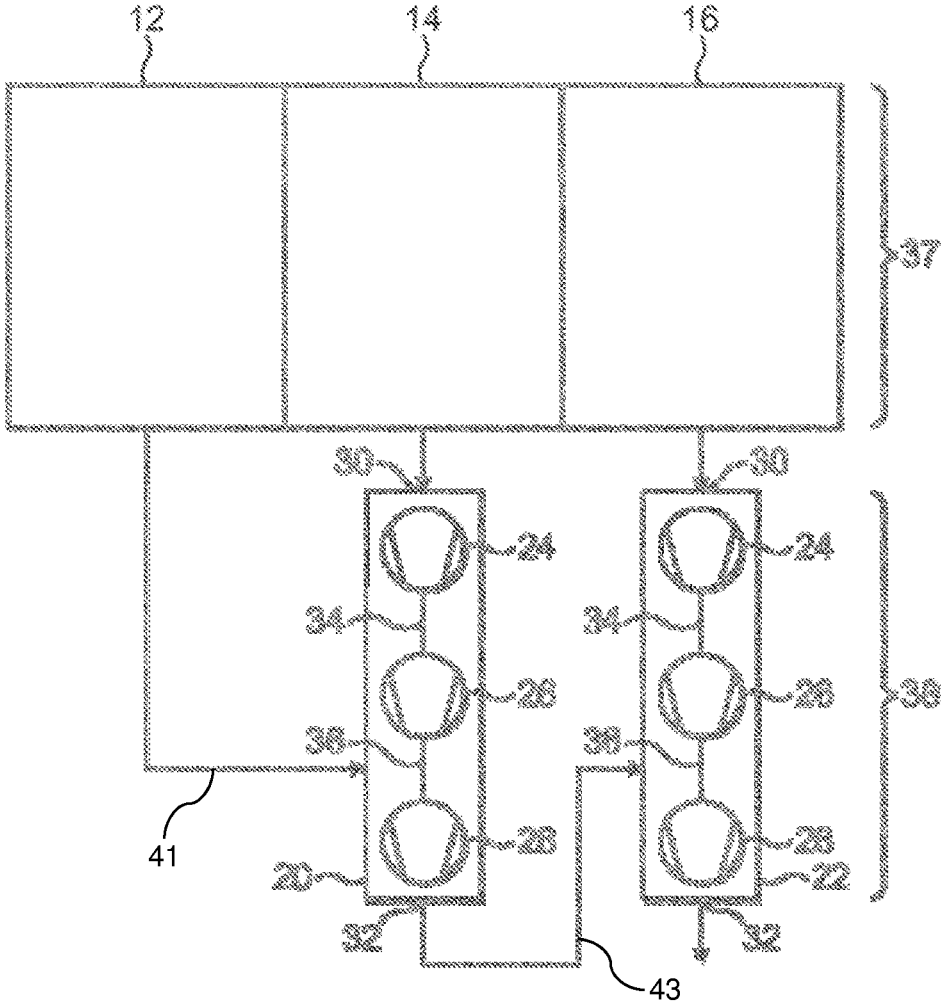
FIG. 2 shows a second vacuum system comprising a plurality of vacuum chambers and a vacuum pumping system.

In an alternative arrangement shown in FIG. 2, a vacuum system 37 comprises vacuum pumping system 38 which is configured such that the interstage port 36 of compound pump 20 is connected to chamber 12 by a conduit 41 so that gas from the chamber is pumped by the third pumping mechanism 28 downstream of the interstage port 36. The exhaust of pump 20 is connected to the interstage port 36 of pump 22 by a conduit 43 so that gas exhausted from pump 20 is pumped by the third pumping mechanism 28 of pump 22 downstream of interstage port 36. Accordingly, respective compound pumps 20, 22 are connected so that gas from one of the chambers can be pumped by the pumping mechanisms 28 in series one after another. Accordingly, gas from chamber 12 is evacuated by the final pumping mechanisms of both of the pumps 20, 22 one after another.

In the FIG. 2 arrangement, the maximum compression available increases due to the gas being pumped in series by two pumping mechanisms 28. For example if the pumping mechanisms 28 of pumps 20, 22 are identical and each have a compression ratio of approximately 3:1, two pumping mechanisms in series (i.e. one mechanism backing the other mechanism), the compression ratio would be approximately 9:1. Additionally, backing the exhaust of pump 20 with the third pumping mechanism of pump 22 decreases the exhaust pressure in the first pump and hence reduces its power consumption.

Figure 3:
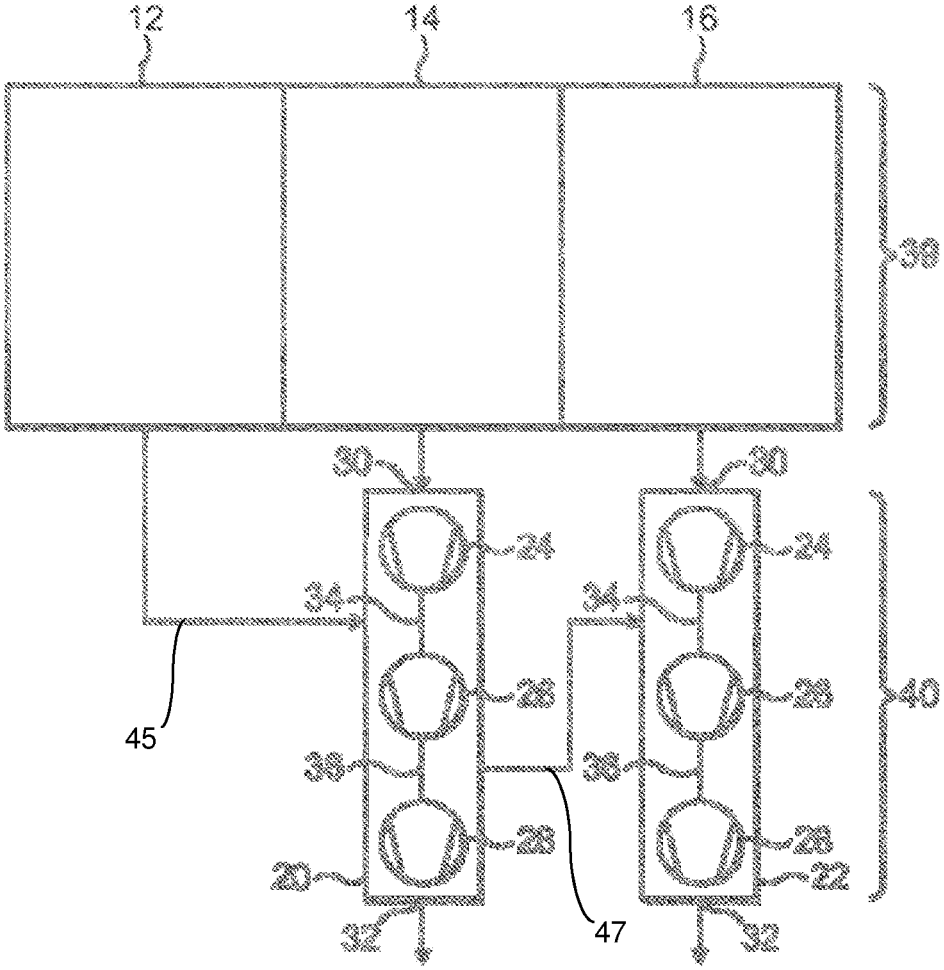
FIG. 3 shows a third vacuum system comprising a plurality of vacuum chambers and a vacuum pumping system.

Referring to FIG. 3, a vacuum system 39 comprises a vacuum pumping system 40 which is configured such that the first interstage port 34 of the first compound pump 20 is connected to chamber 12 by a conduit 45 and the second interstage port 36 of the first compound pump 20 is connected to the first interstage port 34 of the second compound pump 22 by a conduit 47. In this way, gas from chamber 12 can be pumped in series through the second pumping mechanism 26 of the first pump 20 and the second 26 and third 28 pumping mechanisms of the second pump 22. Accordingly, the compression ratio achievable in this arrangement is a multiple of the compression ratios of two pumping mechanisms 26 and a pumping mechanism 28. Further, power consumption of the first pump is reduced as it is backed by pumping mechanisms 26, 28 of the second pump 22.

Figure 4:
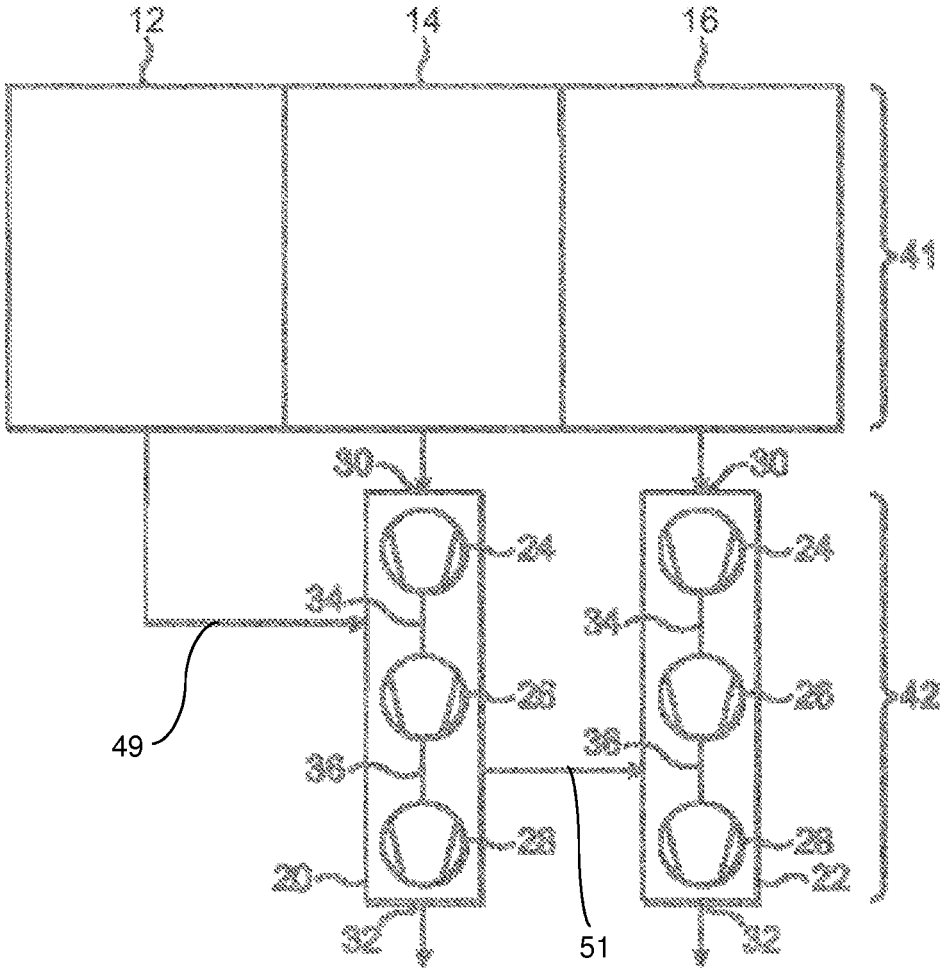
FIG. 4 shows a fourth vacuum system comprising a plurality of vacuum chambers and a vacuum pumping system.

Referring to FIG. 4, a vacuum system 41 comprises a vacuum pumping system 42 which is configured such that the first interstage port 34 of the first compound pump 20 is connected to chamber 12 by a conduit 49 and the second interstage port 36 of the first compound pump 20 is connected to the second interstage port 36 of the second compound pump 22 by a conduit 51. In this way, gas from chamber 12 can be pumped in series through the second pumping mechanism 26 of the first pump 20 and the third pumping mechanism 28 of the second pump 22. Accordingly, the compression ratio achievable in this arrangement is a multiple of the compression ratios of pumping mechanism 26 and pumping mechanism 28. Further, power consumption of the first pump is reduced as it is backed by pumping mechanism 28 of the second pump 22.

Figure 5:
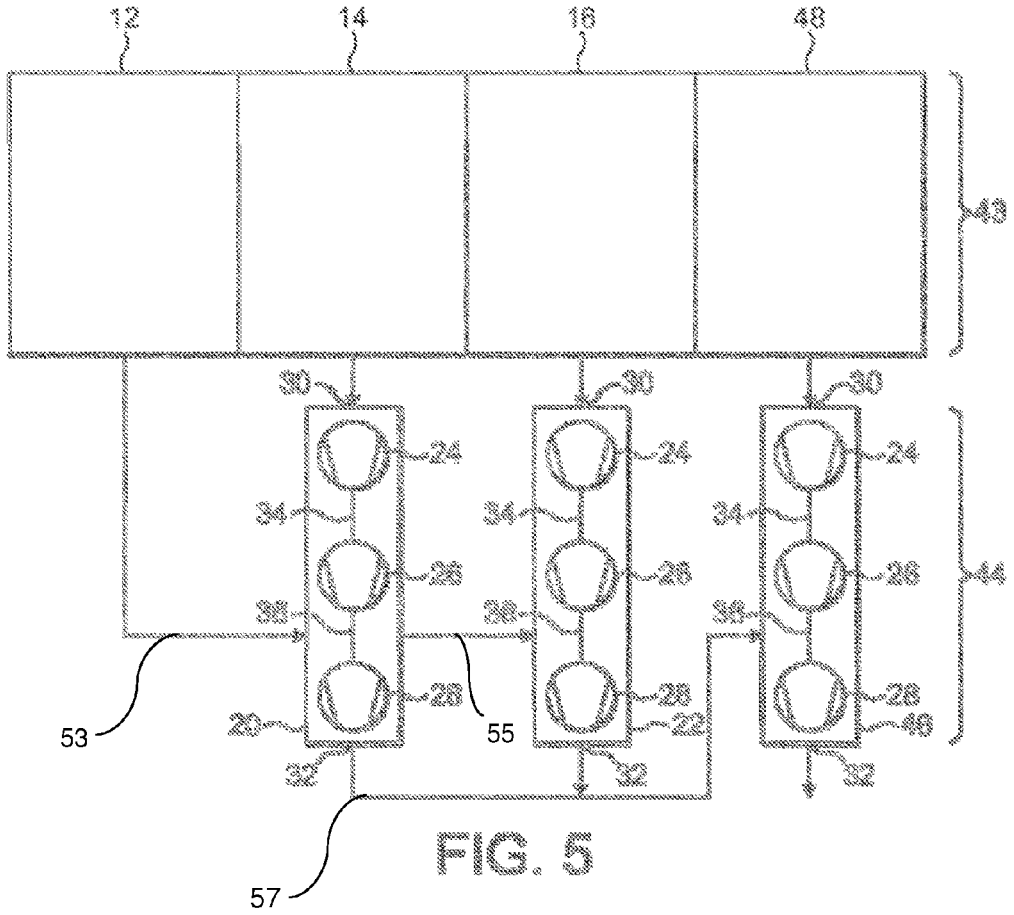
FIG. 5 shows a fifth vacuum system comprising a plurality of vacuum chambers and a vacuum pumping system.
Figure 6:
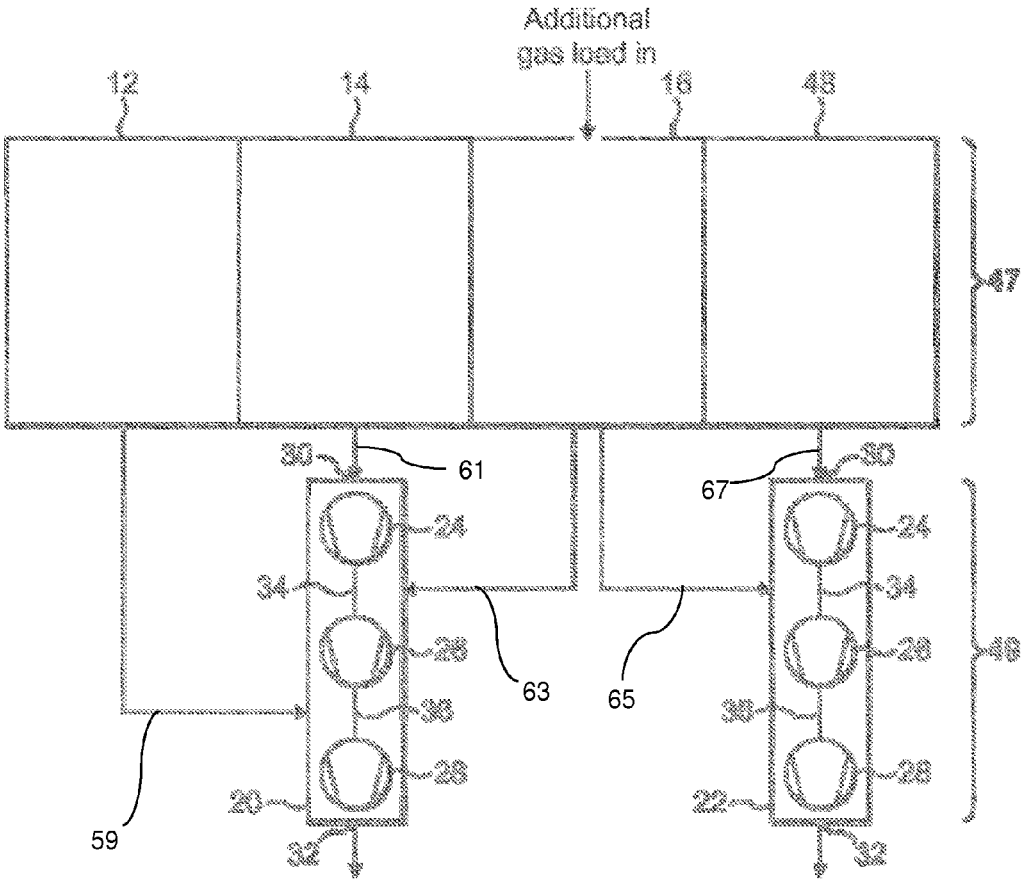
FIG. 6 shows a sixth vacuum system comprising a plurality of vacuum chambers and a vacuum pumping system.
Figure 7:
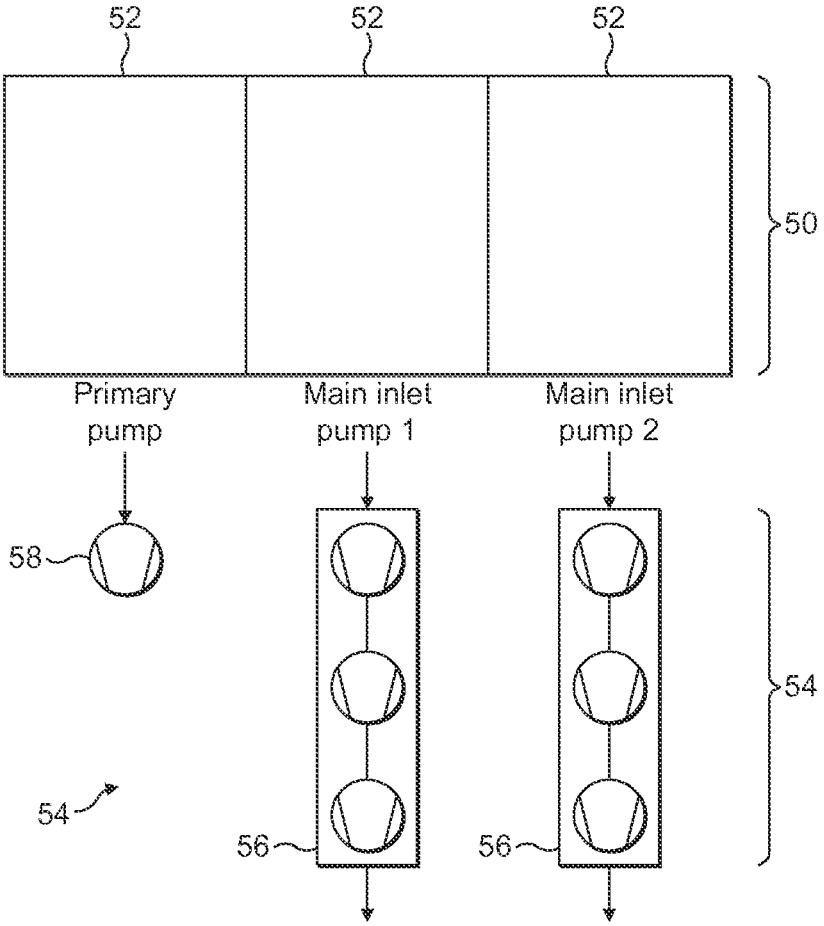
FIG. 7 PRIOR ART
FIG. 7 shows a prior art vacuum system comprising a plurality of vacuum chambers and a vacuum pumping system.

Referring to FIG. 5, a vacuum system 43 is shown which comprises a vacuum pumping system 44 comprising a third compound pump 46 connected to a fourth chamber 48. When the arrangement comprises such a third pump, one or both of the second 26 and third 28 pumping mechanisms of the third compound pump 46 can be connected in series or parallel for pumping gas from a chamber with one or both of the second 26 and third 28 pumping mechanisms of the first or second compound pumps 20, 22. FIG. 5 shows one such example. The pumping system 44 is configured such that respective second interstage ports 36 of first and second compound pumps 20, 22 are connected to chamber 12 by respective conduits 53 and 55 so that gas from the chamber can be pumped by the third pumping mechanisms 28 of the first and the second compound pumps 20, 22 in parallel. Additionally, respective exhausts 32 of the first and the second compound pumps 20, 22 are connected to the second interstage port 36 of the third compound pump 46 by a conduit 57 so that gas exhausted from the first and the second compound pumps 20, 22 can be pumped in series through the third pumping mechanism 28 of the third compound pump 46.

Referring to FIG. 6, a vacuum system 47 is shown which comprises a vacuum pumping system 49. Vacuum system 47 comprises a fourth vacuum chamber 48 and two compound pumps 20, 22 configured for connection for differentially pumping the vacuum chambers. In the arrangement shown, a first chamber 12 is connected to the second interstage port 36 of the first compound pump 20 by a conduit 59 for pumping the chamber 12 by a third pumping mechanism 28 at a pressure of about 1 to 10 mbar. Typically the third pumping mechanism in series in a compound pump is a relatively low vacuum mechanism and therefore suited for pumping a first chamber 12 at relatively low vacuum. A second vacuum chamber 14 at higher vacuum than the first vacuum chamber is connected to the main inlet 30 of the first compound pump 20 by a conduit 61. Gas evacuated from chamber 14 is pumped in series through first, second and third pumping mechanisms 24, 26, 28 of the first compound pump 20. Accordingly, vacuum chamber 14 is evacuated by high vacuum pumping mechanisms 24 and 26, and additionally low vacuum pumping mechanism 28.

The third vacuum chamber 16 is connected to the first interstage ports 34 of the both the first and second compound pumps by respective conduits 63 and 65 so that chamber 16 is pumped by the second and third pumping mechanisms 26, 28 of the first and the second compound pumps 20, 22. Vacuum chamber 16 is therefore pumped by four pumping mechanisms and can achieve relatively high pumping speeds. A fourth vacuum chamber 48 is connected to the main inlet 30 of the second compound pump 22 by a conduit 67 so that the fourth chamber can be pumped by the first, second and third pumping mechanisms 24, 26, 28 of the second compound pump 22. Accordingly, vacuum chamber 48 is evacuated by high vacuum pumping mechanisms 24 and 26, and additionally low vacuum pumping mechanism 28 and can therefore be evacuated to relatively high vacuum in the region of $10^{-3}$ to $10^{-6}$ mbar.

As will be seen in FIG. 6, the arrangement provides four chambers which can be differentially pumped by only two compound pumps by adopting pumping of at least one of the chambers through interstage ports of two compound pumps. Previously, four chambers would have to be differentially pumped by more than two pumps, increasing cost and power consumption.

The invention claimed is:

1. A vacuum pumping system for evacuating gas from a plurality of chambers at different pressures, the pumping system comprising a plurality of compound vacuum pumps, wherein each compound pump comprises a plurality of pumping mechanisms connected in series between a pump inlet and a pump exhaust and an interstage port between pumping mechanisms in the series, wherein the system is configured such that a respective interstage port of each of at least two compound pumps is connected to one of the chambers so that gas from the chamber is pumped by respective downstream pumping mechanisms of the compound pumps in parallel.

2. The vacuum pumping system as claimed in claim 1, wherein in each compound pump the interstage port is located between a said pumping mechanism which is upstream thereof and a said pumping mechanism which is downstream thereof, and wherein after gas is pumped into the interstage port the gas is pumped by the downstream pumping mechanism.

3. The vacuum pumping system as claimed in claim 2, wherein the system is configured such that the downstream pumping mechanisms of said at least two respective compound pumps are connected to an interstage port of a third compound pump so that gas from the at least two respective compound pumps is pumped by a downstream pumping mechanism in the third pump.

4. A vacuum pumping system for evacuating gas from a plurality of chambers at different pressures, the pumping system comprising a first compound pump and a second compound pump, wherein each compound pump comprises first, second and third pumping mechanisms connected in series between a pump inlet and a pump exhaust, a first interstage port located between first and second pumping mechanisms and a second interstage port located between second and third pumping mechanisms, wherein the system is configured such that the first interstage port of the first compound pump is connected to one of the chambers and the second interstage port of the first compound pump is connected to one of: the first interstage port of the second compound pump and the second interstage port of the second compound pump, so that gas from one of the chambers can be pumped in series through a pumping mechanism of the first compound pump and at least the third pumping mechanisms of the second compound pump while bypassing the first pumping mechanism of the second compound pump.

5. The vacuum pumping system as claimed in claim 4, wherein the system is configured such that the second interstage port of the first compound pump is connected to the first interstage port of the second compound pump so that gas from one of the chambers is pumped in series through the second pumping mechanism of the first compound pump and the second and third pumping mechanisms of the second compound pump.

6. The vacuum pumping system as claimed in claim 4, wherein the system is configured such that the second interstage port of the first compound pump is connected to the second interstage port of the second compound pump so that gas from one of the chambers is pumped in series through the second pumping mechanism of the first compound pump and the third pumping mechanism of the second compound pump.

7. A vacuum pumping system as claimed in any one of the preceding claims, wherein the pumping mechanisms of the compound pumps comprise a combination of a turbomolecular pumping mechanism and/or a drag pumping mechanism and/or a regenerative pumping mechanism.

8. The vacuum pumping system as claimed in claims 1 or 4, wherein the other chambers are connected to the pump inlets of respective compound pumps.

* * * * *